US006827612B2

(12) United States Patent
Wu

(10) Patent No.: US 6,827,612 B2
(45) Date of Patent: Dec. 7, 2004

(54) LOW PROFILE ELECTRICAL CONNECTOR HAVING IMPROVED TERMINALS

(75) Inventor: Jerry Wu, Irvine, CA (US)

(73) Assignee: Hon Hai Precision Ind. Co., Ltd., Taipei Hsien (TW)

( * ) Notice: Subject to any disclaimer, the term of this patent is extended or adjusted under 35 U.S.C. 154(b) by 0 days.

(21) Appl. No.: 10/405,784

(22) Filed: Apr. 1, 2003

(65) Prior Publication Data

US 2004/0009706 A1 Jan. 15, 2004

Related U.S. Application Data

(63) Continuation-in-part of application No. 10/194,121, filed on Jul. 11, 2002, now Pat. No. 6,716,068.

(51) Int. Cl.[7] ..... H01R 23/70
(52) U.S. Cl. ..... 439/637; 439/733.1
(58) Field of Search ..... 439/636, 637, 439/326, 630, 633, 634, 60, 733.1, 746, 59–62, 108, 857

(56) References Cited

U.S. PATENT DOCUMENTS

| | | | | |
|---|---|---|---|---|
| 5,556,308 A | * | 9/1996 | Brown et al. | 439/746 |
| 5,785,556 A | * | 7/1998 | Pratt et al. | 439/637 |
| 6,174,187 B1 | * | 1/2001 | Yamagami et al. | 439/326 |
| 6,312,296 B1 | | 11/2001 | Jones | |

* cited by examiner

*Primary Examiner*—Alex Gilman
(74) *Attorney, Agent, or Firm*—Wei Te Chung

(57) ABSTRACT

An electrical connector (10) includes an insulative housing (20) and a number of terminals (30, 40) retained in the insulative housing. The insulative housing defines a number of receiving passageways (24) for respectively receiving the terminals. The terminals each include a mating arm (308, 408) at a bottom end thereof for electrically connecting with a mating PCB (50) and a locking arm extending upwardly from the bottom end thereof. At least one locking arm engages with a bottom surface (501) of the PCB to prevent the terminals from moving upwardly.

7 Claims, 8 Drawing Sheets

LOW PROFILE ELECTRICAL CONNECTOR HAVING IMPROVED TERMINALS

CROSS-REFERENCE TO RELATED APPLICATION

This patent application is a continuation-in-part of U.S. patent application Ser. No. 10/194,121, filed on Jul. 11, 2002 now U.S. Pat. No. 6,716,068.

BACKGROUND OF THE INVENTION

1. Field of the Invention

The present invention relates to a low profile electrical connector, and more particularly to a low profile electrical connector having improved terminals.

2. Description of Related Art

An organization, named Serial Advanced Technology Attachment (SATA) Working Group released a specification defining an SATA interface. The SATA interface is used to connect storage devices such as hard disk, DVD and CD-ROM drives to a PC motherboard. The specification defines a first type SATA connector connected with a cable and a second type SATA connector mounted on a printed circuit board (PCB).

The second type SATA connector defined by the specification includes an insulative housing and a plurality of terminals. The terminals are retained in the housing and partly extend out of the housing for electrically connecting with the PCB. For simplifying the mounting process of the SATA connector to the PCB, the SATA connector is provided with press-fit terminals which have needle-eyed tails for being forcibly fitted into metal plated through holes of the PCB thereby ensuring a secured connection between the SATA connector and the PCB.

FIG. 1 of U.S. Pat. No. 6,312,296 discloses an electrical connector (1) with press-fit terminals (40). The terminals each comprise a needle-eyed pin (41) on a lower end thereof for insertion into a PCB. However, while the assembled electrical connector and PCB are subjected to vibration or shake, the press-fit engagement between the terminals and the PCB is perhaps affected and failed. Therefore, in turn, the electrical connection between the electrical connector and the PCB is not secured.

Hence, an electrical connector with improved terminals is required to overcome the disadvantages of the conventional electrical connector.

SUMMARY OF THE INVENTION

Accordingly, an object of the present invention is to provide an electrical connector having improved terminals assuring a secure connection between the electrical connector and a PCB on which the electrical connector is mounted.

To obtain the above object, an electrical connector of the present invention includes an insulative housing and a plurality of terminals retained in the insulative housing. The insulative housing defines a plurality of receiving passageways for respectively receiving the terminals. The terminals each includes a mating arm at a bottom end thereof for electrically connecting with a mating PCB and a locking arm extending upwardly from the bottom end thereof for engaging with the PCB. At least one locking arm engages with a bottom surface of the PCB to prevent the terminals from moving upwardly.

Other objects, advantages and novel features of the invention will become more apparent from the following detailed description of the present embodiment when taken in conjunction with the accompanying drawings.

DETAILED DESCRIPTION OF THE INVENTION

Figure 1:
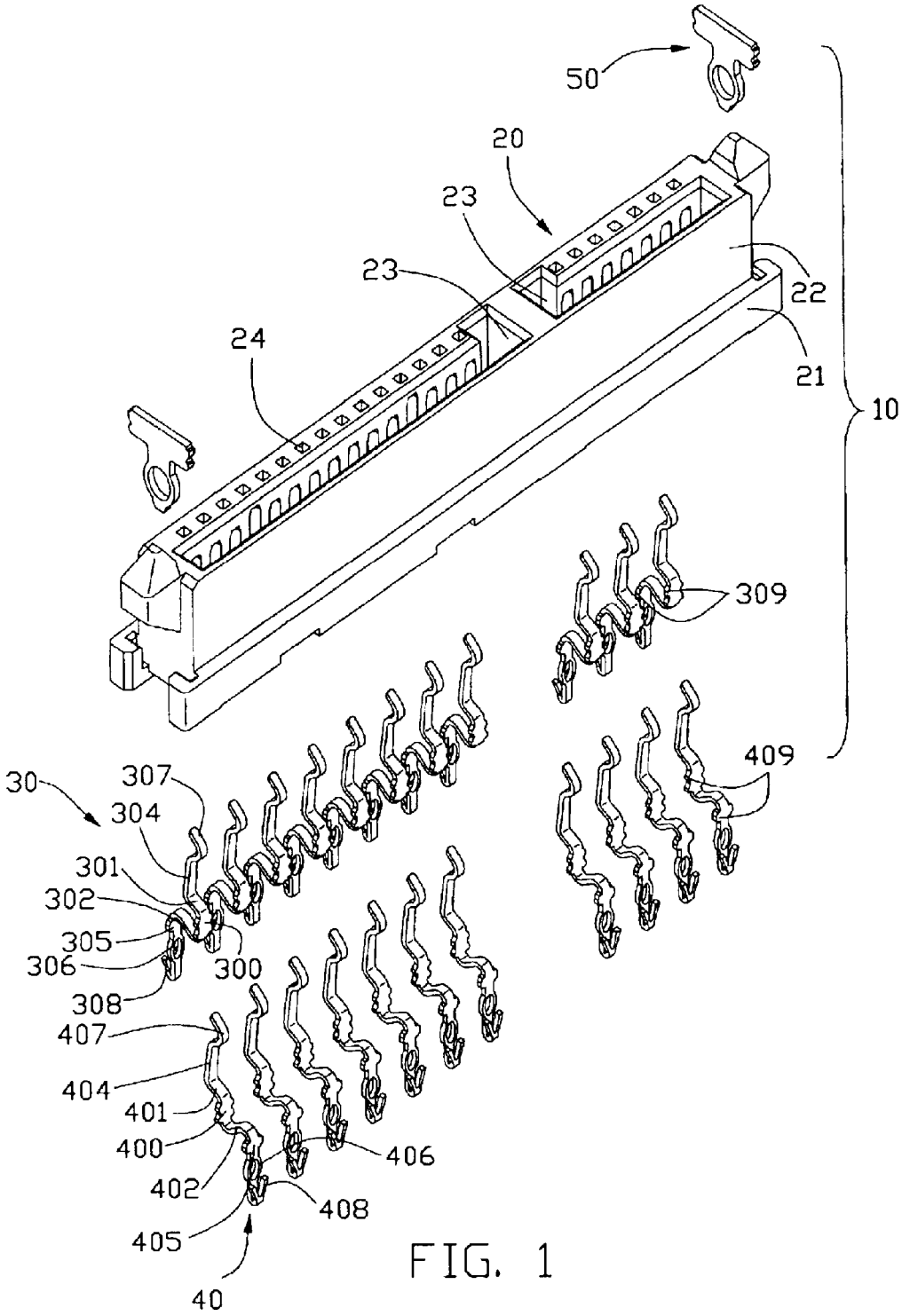
FIG. 1 is a top, front and left perspective exploded view of an electrical connector in accordance with the present invention.

An electrical connector mounted on a PCB generally includes an insulative housing and a plurality of terminals retained in the insulative housing. The insulative housing defines a plurality of passageways for receiving the terminals therein. The terminals are designed to meet certain requirements of mechanical and electrical performances. FIGS. 1–8 of the attached drawings show an SATA electrical connector having terminals constructed in accordance with the present invention. The following description of the terminals of the present invention is illustrative only, not to restrict the use and application of the terminals. The terminals can also be used in electrical connectors of other types.

Referring to FIGS. 1–4, an electrical connector 10 in accordance with the present invention includes an insulative housing 20, a plurality of first and second terminals 30, 40 retained in the insulative housing 20 and a pair of board locks 50.

The insulative housing 20 includes a rectangular base portion 21 and a rectangular tongue plate 22 extending upwardly from a top end of the base portion 21. The tongue plate 22 defines a pair of longitudinal receiving slots 23. The insulative housing 20 defines a row of vertical receiving passageways 24 respectively and partially communicating with the receiving slots 23. The base portion 21 defines two rows of opposite T-shaped retaining recesses 25 on a bottom side thereof. The two rows of retaining recesses 25 are arranged in stagger manner so that the each of retaining recesses 25 aligns with one corresponding receiving passageways 24. The receiving passageways 24 are the same in configurations but, referring to FIG. 7, two of them are higher than the others in a vertical position. Similarly, the retaining recesses 25 are the same in configurations, and two of them are higher than the others in the vertical position.

Figure 2:
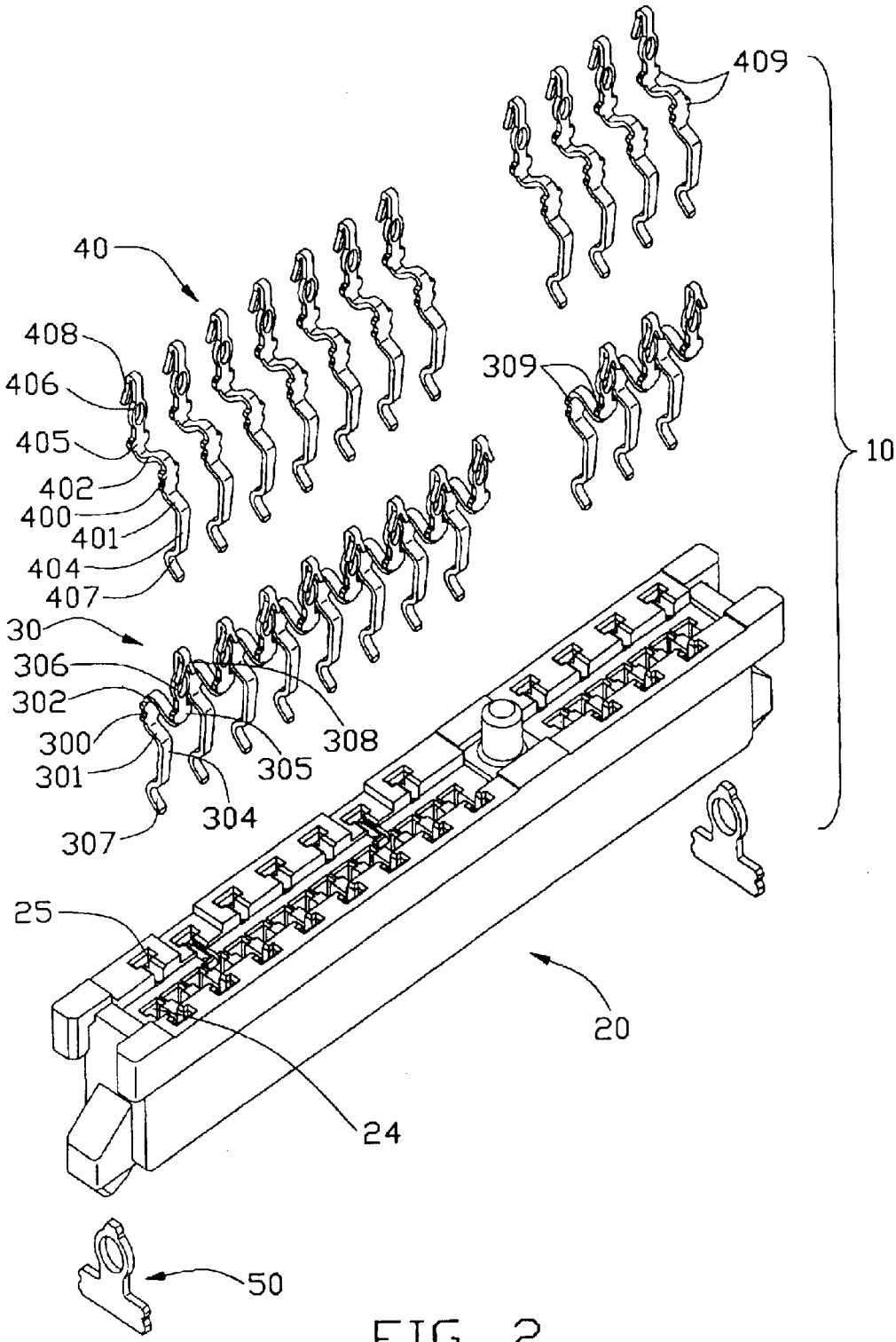
FIG. 2 is a bottom, front and left perspective exploded view of the electrical connector of FIG. 1.
Figure 3:
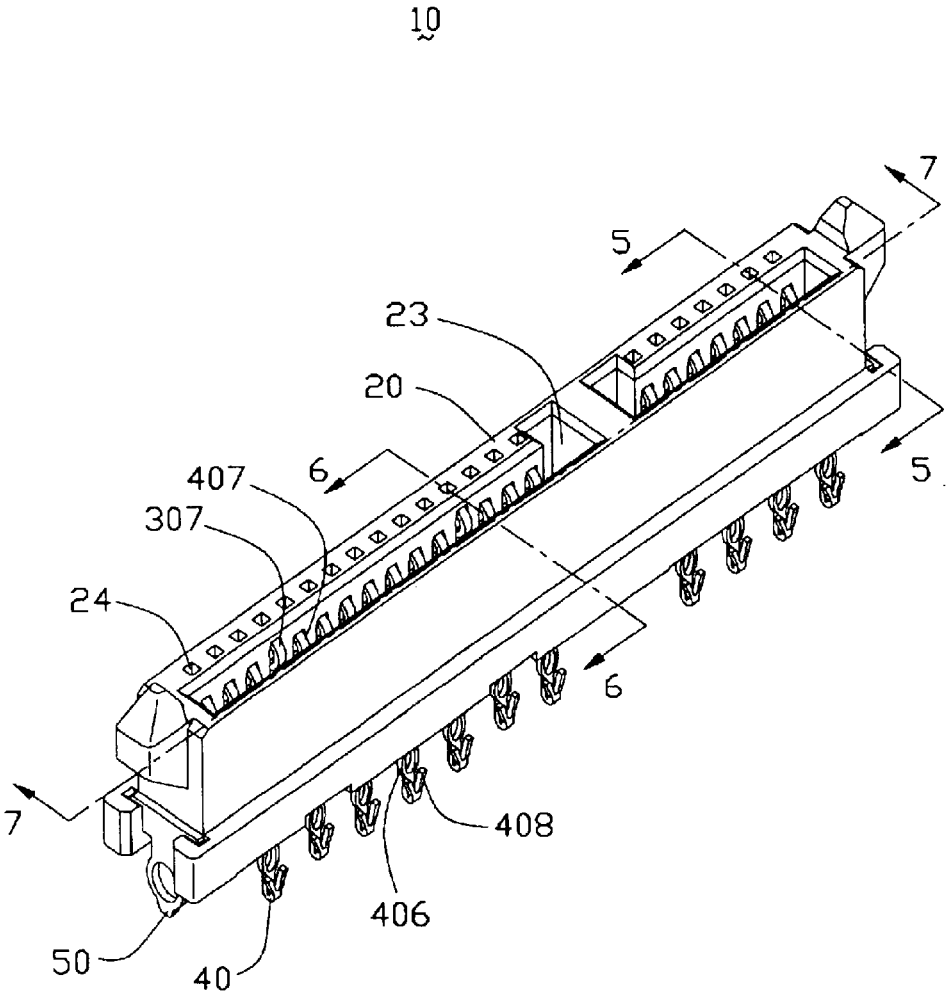
FIG. 3 is an assembled view of the electrical connector of FIG. 1.
Figure 4:
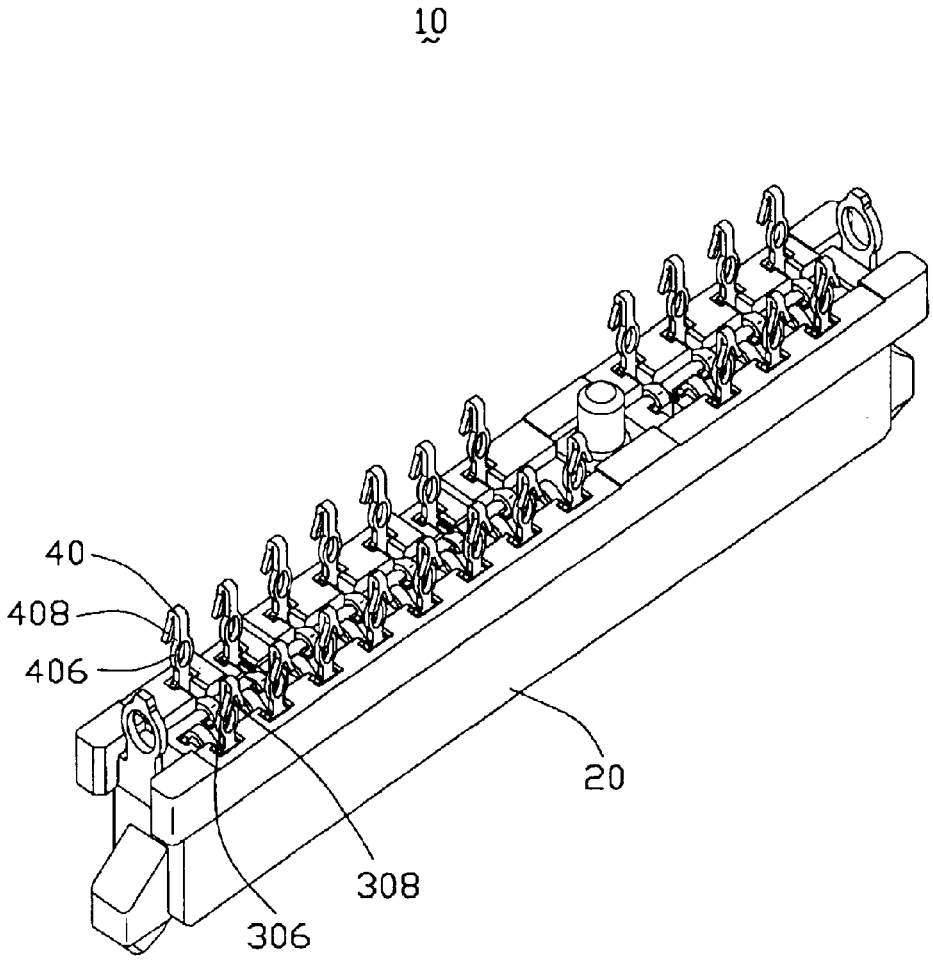
FIG. 4 is an assembled view of the electrical connector of FIG. 2.
Figure 5:
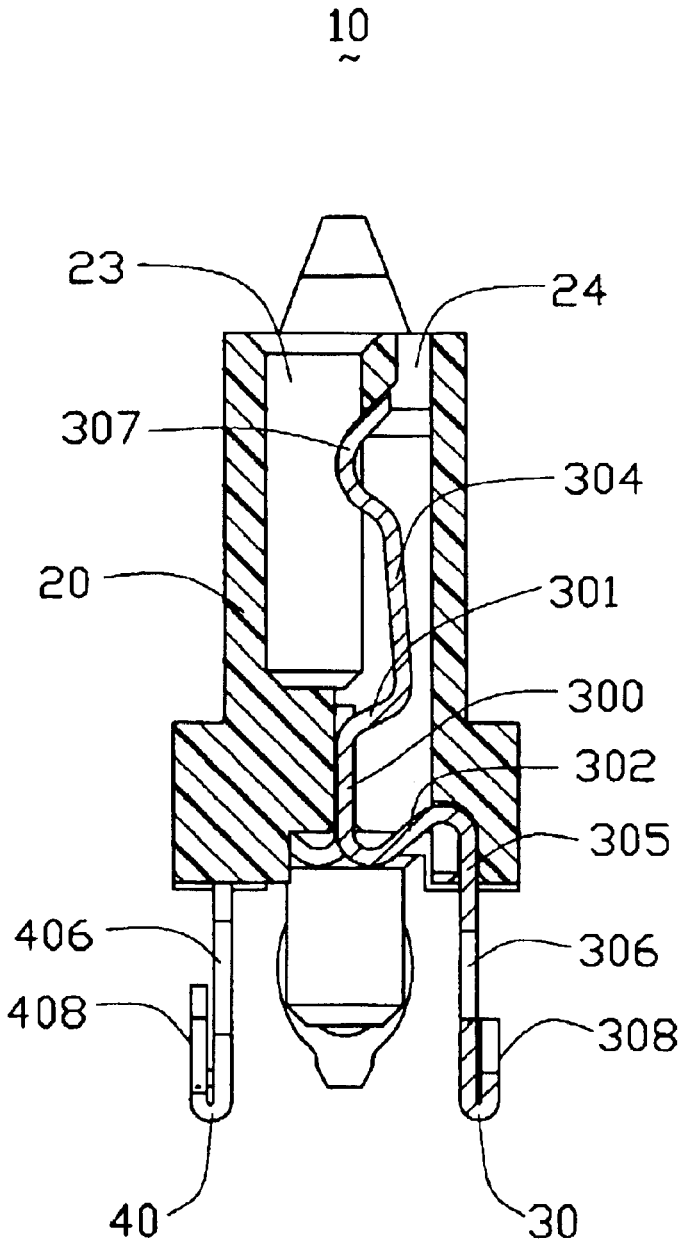
FIG. 5 is a cross-sectional view of the electrical connector taken along line 5—5 of FIG. 3.
Figure 6:
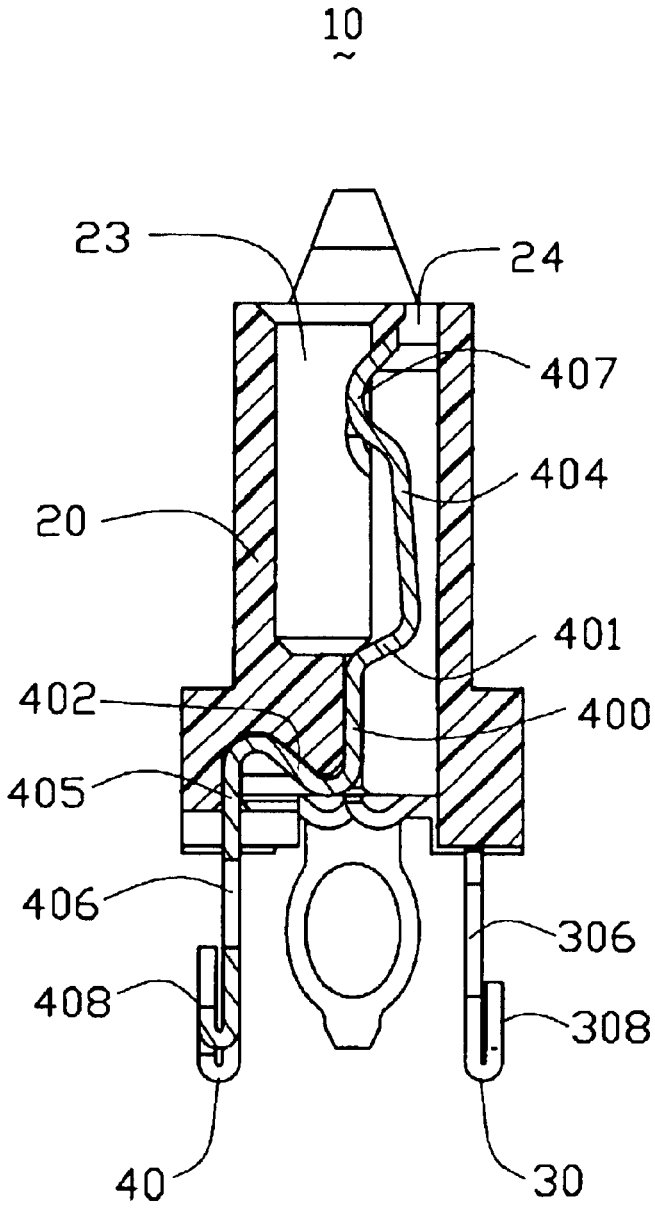
FIG. 6 is a cross-sectional view of the electrical connector taken along line 6—6 of FIG. 3.
Figure 7:
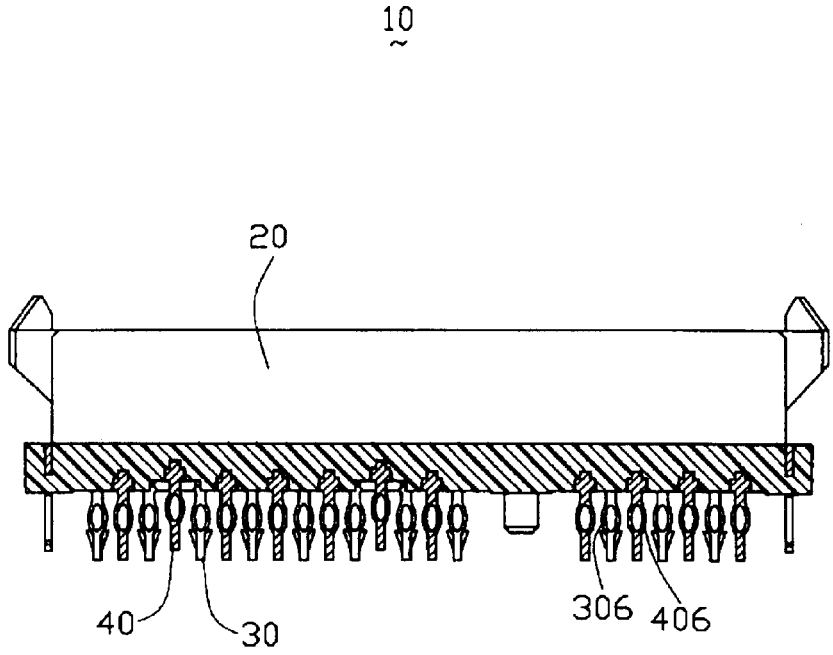
FIG. 7 is a cross-sectional view of the electrical connector taken along line 7—7 of FIG. 3.

The first and second terminals 30, 40, best shown in FIGS. 1–2, are substantially similar in shape. The first terminals 30 each include a first retaining arm 300, an upper and a lower connecting arms 301, 302 extending toward a same direction, a spring arm 304 extending upwardly from the upper connecting arm 301, a second retaining arm 305 extending downwardly from the lower connecting arm 302, a mating arm 306 extending downwardly from a bottom end of the second retaining arm 304 and a curved contacting arm 307 extending upwardly from a top end of the spring arm 304.

Similarly, the second terminals 40 each include a first retaining arm 400, an upper and a lower connecting arms 401, 402 extending toward two opposite directions, a spring arm 404 extending upwardly from the upper connecting arm 401, a second retaining arm 405 extending downwardly from the lower connecting arm 402, a mating arm 406 extending downwardly from a bottom end of the second retaining arm 405 and a curved contacting arm 407 extending upwardly from a top end of the spring arm 404.

The first and second terminals 30, 40 each respectively include a pair of locking arms 408 extending upwardly and oppositely from a bottom end thereof. In addition, the first and second retaining arms 300, 302 (400, 402) of the first (second) terminals 30 (40) each include a plurality of barbs 309 (409) extending outwardly therefrom. The mating arm 306 (406) is a needle-eyed tail.

In assembly, the first and second terminals 30, 40 are alternately inserted into the receiving passageways 24 of the insulative housing 20. Referring to FIGS. 3–6, the first retaining arms 300 (400) and the upper and lower connecting arms 301, 302 (401, 402) of the first (second) terminals 30 (40) are respectively received in the receiving passageways 24 with the contacting arms 307 (407) projecting into the receiving slots 23 for electrically mating with a mating connector (not shown). The second retaining arms 305 (405) of the first (second) terminals 30 (40) are respectively retained in the receiving recesses 25 of the insulative housing 20 with the mating arms 308 extending downwardly beyond a bottom surface of the insulative housing 20 for inserting into a PCB 50 (FIG. 8) on which the electrical connector 10 is mounted. The barbs 309 (409) of the first and second retaining arms 300, 305 (400, 405) engage with the insulative housing 20 thereby securely retaining the first (second) terminals 30, 40 in the insulative housing 20.

Figure 8:
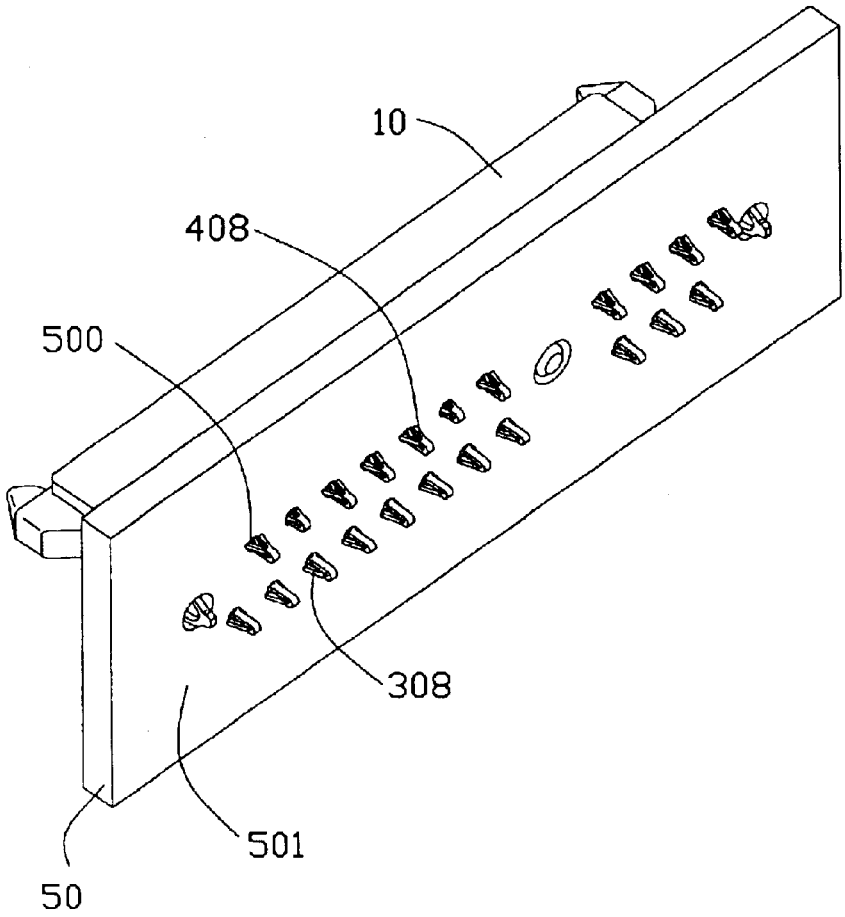
FIG. 8 is a perspective view of the electrical connector and a PCB on which the electrical connector is mounted.

Referring to FIG. 8, while the electrical connector 10 is assembled to the PCB 50, the mating arms 306 (406) of the first (second) terminals 30 (40) are received in corresponding receiving holes 500 of the PCB 50 with the locking arms 308 (408) below the PCB 5. As two of the receiving passageways 24 and two corresponding receiving recesses 25 are higher than the others in the vertical position, two second terminals 30 retained in the two receiving passageways 24 and recesses 25 are also higher than the others. Thus, the mating arms 406 of two second terminals 30 electrically connect with the PCB 5 in a later time than those of the other terminals 30, 40. The locking arms 308, 408 of the other second terminals 30 and the first terminals 40 are fully inserted through the receiving holes 500 and below the PCB 50, therefore, the locking arms 308, 408 engage with a bottom surface 501 of the PCB 50 and exert an upward force on the PCB 50 whereby the electrical connector 10 is prevented from moving upwardly. Thus, even if the PCB 50 and the electrical connector 10 are subjected to shock, a secured electrical connection is assured between the PCB 50 and the electrical connector 10.

The configurations of the other elements and the other relationships between the elements of the electrical connector 10 are the same as those in the parent patent application from which this patent claims priority. The configurations of the other elements of the electrical connector are not described herein and one can refer to the mother patent applications.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. An electrical connector adapted for being mounted on a PCB, comprising:

an insulative housing defining a plurality of passageways; and a plurality of two rows of terminals being respectively received in the receiving passageways of the insulative housing and each comprising a compliant press-fit mating arm at a bottom end thereof and a locking arm extending upwardly from the bottom end; wherein at least one locking arm is adapted for engaging with a bottom surface of the PCB wherein said locking arm includes a pair of locking arms extending upwardly and oppositely from a bottom end thereof forming V-shape.

2. The electrical connector as claimed in claim 1, wherein each terminal comprises a first retaining arm for engaging with the insulative housing.

3. The electrical connector as claimed in claim 2, wherein each terminal comprises an upper and a lower connecting arms extending from opposite ends of the first retaining arm.

4. The electrical connector as claimed in claim 3, wherein the terminals each comprise a second retaining arm extending downwardly from the lower connecting arm and engaging with the insulative housing.

5. The electrical connector as claimed in claim 2, wherein the terminals comprise a first and a second terminals, the upper and lower connecting arms of the first terminal extending toward a same direction and the upper and lower connecting arms of the second terminal extending in opposite direction.

6. An electrical connector assembly comprising:

a printed circuit board defining a row of through holes;

an electrical connector including:

an insulative housing;

two rows of terminals disposed in the housing, each of said terminals including a U-shaped end portion of a tail, wherein one arm of said U-shaped end portion integrally downwardly extends from a mating arm of the tail, said mating arm extending through and compliantly engaged with the corresponding through hole, and the other arm of said U-shaped end portion upwardly extends from a lower end of said one arm with a locking arm latched to an underside of the printed circuit board wherein said locking arm includes a pair of locking arms extending upwardly and oppositely from a bottom end thereof forming V-shape.

7. The assembly as claimed in claim 6, wherein said locking arm is deflected in a plane defined by said other arm.

* * * * *